US006468169B1

(12) United States Patent
Hayashi et al.

(10) Patent No.: US 6,468,169 B1
(45) Date of Patent: Oct. 22, 2002

(54) MULTI-PIECE SOLID GOLF BALL

(75) Inventors: Junji Hayashi; Hisashi Yamagishi; Hiroshi Higuchi, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 368 days.

(21) Appl. No.: 09/086,493

(22) Filed: May 29, 1998

Related U.S. Application Data

(60) Provisional application No. 60/049,603, filed on Jun. 13, 1997.

(30) Foreign Application Priority Data

May 29, 1997 (JP) ..... 9-155811

(51) Int. Cl.[7] ..... A63B 37/12
(52) U.S. Cl. ..... 473/371; 473/354; 473/376
(58) Field of Search ..... 473/376, 354, 473/371

(56) References Cited

U.S. PATENT DOCUMENTS 5,816,937 A * 10/1998 Shimosaka et al. ..... 473/354

* cited by examiner

*Primary Examiner*—William M. Pierce
(74) *Attorney, Agent, or Firm*—Sughrue Mion, PLLC

(57) ABSTRACT

A multi-piece solid golf ball comprising a core consisting of an inner sphere and an enclosure layer surrounding the inner sphere and a cover surrounding the core and consisting of an outer layer and an inner layer is characterized in that the outer layer of the cover has a hardness of 40–60 in Shore D, the inner layer of the cover has a hardness of 55–70 in Shore D, the surface hardness of the enclosure layer is higher in Shore D than the surface hardness of the inner sphere, the inner sphere has a hardness expressed by a distortion of 3.0–8.0 mm under an applied load of 100 kg, and the ratio of the hardness A of the inner sphere to the hardness B of the ball, both expressed by a distortion under an applied load of 100 kg, is in the range: $1.1 \leqq A/B \leqq 3.5$.

13 Claims, 1 Drawing Sheet

MULTI-PIECE SOLID GOLF BALL

CROSS REFERENCE TO RELATED APPLICATION

This application is an application filed under 35 U.S.C. §111(a) claiming benefit pursuant to 35 U.S.C. §119(e)(i) of the filing date of the Provisional Application 60/049,603 filed on Jun. 13, 1997 pursuant to 35 U.S.C. §111(b).

BACKGROUND OF THE INVENTION

1. Field of the Invention

This invention relates to a multi-piece solid golf ball of a four layer structure comprising a core consisting of an inner sphere and an enclosure layer surrounding the inner sphere and a cover surrounding the core and consisting of outer and inner layers. More particularly it relates to such a multi-piece solid golf ball which is improved in spin performance upon approach shots with a sand wedge etc. and presents a soft hitting feel upon approach shots and putting and at the same time, travels an increased distance and gives a pleasant soft hitting feel upon full shots with a driver independent of whether the head speed is high or low.

2. Prior Art

Two-piece solid golf balls comprising a rubber based core and a cover of ionomer resin or the like around the core offer superior flight performance and durability although they have the drawback of a hard hitting feel. To eliminate this drawback, various soft type two-piece solid golf balls were developed. To obtain such soft type two-piece solid golf balls, soft cores are generally used. Softening the core invites not only a lowering of restitution which leads to poor flight performance, but also a substantial loss of durability. Then the flight performance and durability characteristic of two-piece solid golf balls are lost to such an extent that some soft type two-piece solid golf balls are practically unacceptable.

To overcome these problems, a number of three-piece solid golf balls were proposed. Exemplary golf balls attempted heretofore include (1) a three-piece solid golf ball comprising a core consisting of inner and outer layers and a cover surrounding the core wherein the core consists of a soft, relatively small inner layer (outer diameter: 24 to 29 mm, hardness: Shore D 15 to 30) and a hard outer layer (outer diameter: 36 to 41 mm, hardness: Shore D 55 to 65) surrounding the inner layer whereby a long carry is ensured as well as a hitting feel and controllability close to wound golf balls (Japanese Patent Publication (JP-B) No. 55077/1992 and Japanese Patent Application Kokai (JP-A) No. 80377/1989); (2) a three-piece solid golf ball comprising a center core, an intermediate layer, and a cover wherein a soft intermediate layer is formed around a soft center core and the thickness and specific gravity of the center core, intermediate layer, and cover are selected in specific ranges whereby the feeling is improved at no sacrifice of flight performance and durability (JP-A 24084/1995); and (3) a three-piece solid golf ball comprising a center core, an intermediate layer, and a cover wherein a relatively hard intermediate layer is formed between a relatively soft core and a relatively soft cover whereby the feeling and controllability are improved at no sacrifice of flight performance and durability (JP-A 24085/1995).

However, these golf balls suffer from various problems. The ball (1), in which the cover is not particularly limited, provides insufficient restitution and fails to travel a long distance when a soft member is used as the cover. When a hard member is used as the cover, the cover and the underlying core outer layer are hard so that upon approach shots belonging to the low deformation region, the hitting feel becomes hard. The ball (2) gives a good feel upon driver shots because the core and intermediate layer are soft, but gives a hard feel on sand wedge shots and gains a spin rate insufficient to control the ball because the cover is hard. The ball (3), in which the core that mostly affects feel and restitution is soft, provides insufficient restitution and fails to travel a long distance as long as the hitting feel is fully soft. As long as the restitution is sufficient, the core is relatively hard so that the hitting feel is not fully soft. Additionally, the intermediate layer is also hard so that low-head speed players cannot provide the ball with sufficient deformation to travel a long distance. There still remains room for further improvement.

SUMMARY OF THE INVENTION

An object of the present invention, which has been made under the aforementioned circumstances, is to provide a multi-piece solid golf ball comprising a core consisting of an inner sphere and an enclosure layer surrounding the inner sphere and a cover surrounding the core and consisting of outer and inner layers, which is improved in spin performance upon approach shots with a sand wedge etc. and presents a soft hitting feel upon approach shots and putting and at the same time, travels an increased distance and gives a pleasant soft hitting feel upon full shots with a driver independent of whether the head speed is high or low.

Making extensive investigations in order to attain the above object, the inventors have found that when a multi-piece solid golf ball comprising a core consisting of an inner sphere and an enclosure layer surrounding the inner sphere and a cover surrounding the core and consisting of outer and inner layers is formed as a four layer structure comprising a core consisting of a soft inner sphere and a relatively hard enclosure layer and a cover surrounding the core and consisting of a soft outer layer and a hard inner layer, (1) the cover outer layer formed soft is effective for improving spin performance upon approach shots with a sand wedge and makes soft the hitting feel upon approach shots and putting, (2) the use of a hard resilient resin as the cover inner layer is effective for maintaining satisfactory flight performance, and (3) the inner sphere formed relatively soft and the relatively hard, resilient enclosure layer surrounding the inner sphere are effective for presenting a very soft hitting feel while maintaining high restitution upon full shots with a driver independent of whether the head speed is high or low.

Continuing further extensive investigations based on the above findings (1) to (3), the inventors have found that the problems associated with prior art three-piece solid golf balls can be effectively solved when a multi-piece solid golf ball comprising a core consisting of an inner sphere and an enclosure layer surrounding the inner sphere and a cover surrounding the core and consisting of an outer layer and an inner layer is constructed such that the outer layer of the cover has a hardness of 40 to 60 in Shore D, the inner layer of the cover has a hardness of 55 to 70 in Shore D, the surface hardness of the enclosure layer is higher in Shore D than the surface hardness of the inner sphere, the inner sphere has a hardness expressed by a distortion of 3.0 to 8.0 mm under an applied load of 100 kg, and the ratio of the hardness A of the inner sphere to the hardness B of the ball, both expressed by the distortion under an applied load of 100 kg, is in the range: $1.1 \leqq A/B \leqq 3.5$. More specifically, upon full shots with a driver which is in the large deformation region of the ball, especially by low-head speed players, the resulting three-piece solid golf ball is given a sufficient deformation. That is, the ball receives an appropriate spin rate to travel a drastically increased distance and gives a very pleasant soft hitting feel while maintaining high restitution independent of whether the head speed is high or low. In addition, upon approach shots with a sand wedge belonging to the small ball deformation region, the ball is susceptible to spin and easy to control. Furthermore, upon approach shots and putting, the ball gives a soft pleasant feel. The present invention is predicated on these findings.

Accordingly, the present invention provides:

(1) a multi-piece solid golf ball comprising a core consisting of an inner sphere and an enclosure layer surrounding the inner sphere and a cover surrounding the core and consisting of an outer layer and an inner layer, characterized in that the outer layer of said cover has a hardness of 40 to 60 in Shore D, the inner layer of said cover has a hardness of 55 to 70 in Shore D, said enclosure layer has a surface hardness higher than the surface hardness of said inner sphere in Shore D, said inner sphere has a hardness expressed by a distortion of 3.0 to 8.0 mm under an applied load of 100 kg, and the ratio of the hardness A of said inner sphere to the hardness B of the ball, both expressed by a distortion under an applied load of 100 kg, is in the range: $1.1 \leqq A/B \leqq 3.5$;

(2) a multi-piece solid golf ball of (1) wherein said inner sphere is formed mainly of a rubber base material and has a diameter of 20 to 37 mm, and said core has a diameter of 32 to 41 mm;

(3) a multi-piece solid golf ball of (1) or (2) wherein the cover outer layer has a gage of 0.3 to 3.0 mm, the cover inner layer has a gage of 0.5 to 3.0 mm, and the difference in hardness between the outer layer and the inner layer is at least 5 in Shore D; and (4) a multi-piece solid golf ball of (1), (2) or (3) wherein the hardness of the cover inner layer is higher than the hardness of the cover outer layer.

DETAILED DESCRIPTION OF THE INVENTION

Figure 1:
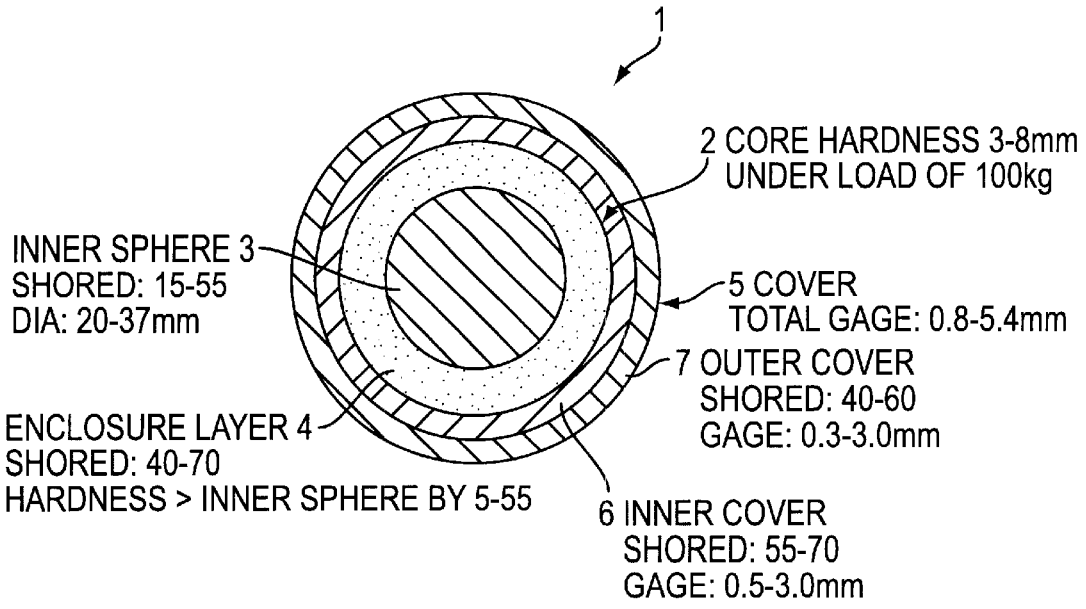
FIG. 1 is a schematic cross section of one exemplary multi-piece solid golf ball according to the invention.

The invention is described below in detail. Referring to FIG. 1, a multi-piece solid golf ball 1 according to the invention is illustrated as a golf ball of a four layer structure comprising a core 2 consisting of an inner sphere 3 and an enclosure layer 4 surrounding the inner sphere and a cover 5 around the core consisting of inner and outer layers 6 and 7. It is noted that the enclosure 4 is not limited to a single layer, but may be formed as a multilayer enclosure consisting of two or more layers.

The inner sphere 3 constituting the core 2 of the inventive golf ball 1 should have a hardness expressed by a distortion of 3.0 to 8.0 mm, preferably 3.5 to 7.5 mm under an applied load of 100 kg. With a distortion of less than 3.0 mm, the core becomes too hard, the flight distance becomes short especially in the case of low-head speed players, and the hitting feel becomes hard. With a distortion of more than 8.0 mm, the core becomes too soft, loses restitution and durability. Also the inner sphere should preferably have a surface hardness of 15 to 55, more preferably 20 to 50 as measured by a Shore D hardness meter (to be referred to as Shore D, hereinafter). The surface hardness of the inner sphere used herein indicates the hardness of the inner sphere at its surface and is an average of 5 measurements.

Also the inner sphere preferably has a diameter of 20 to 37 mm, more preferably 22 to 35 mm. It is understood that the specific gravity, weight and other parameters of the inner sphere may be properly adjusted insofar as the objects of the invention are achievable.

No particular limit is imposed on the composition of which the inner sphere is formed according to the invention. The inner sphere-forming composition may be formed by using a rubber base commonly used in the formation of inner spheres and adding such additives as a crosslinking agent, co-crosslinking agent and inert filler to the rubber base. The rubber base used herein may be natural rubber and/or synthetic rubber conventionally employed in solid golf balls. The invention especially favors cis-1,4-polybutadiene containing at least 40% of cis-structure. If desired, natural rubber, polyisoprene rubber, styrene-butadiene rubber or the like is blended in the polybutadiene. The crosslinking agent is exemplified by organic peroxides such as dicumyl peroxide and di-tert-butyl peroxide. The amount of the crosslinking agent blended is generally about 0.5 to 2.0 parts by weight per 100 parts by weight of the base rubber.

The co-crosslinking agent is exemplified by metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. The amount of the co-crosslinking agent blended may be properly determined although it is usually about 5 to 50 parts by weight per 100 parts by weight of the base rubber. Examples of the inert filler include zinc oxide, barium sulfate, silica, calcium carbonate, and zinc carbonate, with zinc oxide and barium sulfate being typical. The amount of the filler blended varies with the specific gravity of core and cover, the weight of ball and other factors although the filler amount is preferably about 5 to 100 parts by weight per 100 parts by weight of the base rubber. In the practice of the invention, the amounts of the crosslinking agent and filler (typically zinc oxide and barium sulfate) are properly selected to adjust the hardness and weight of the inner sphere to optimum values.

The inner sphere-forming composition obtained by blending the above-mentioned components is kneaded in a conventional kneader such as a Banbury mixer or roll mill, for example, and molded into an inner sphere of the above-defined hardness in an inner sphere mold.

The enclosure layer 4 surrounding the inner sphere 3 should preferably have a surface hardness of 40 to 70, more preferably 45 to 68 in Shore D. The surface hardness of the enclosure layer should be higher than the surface hardness of the inner sphere, preferably higher by 5 to 55 in Shore D, more preferably by 5 to 45 in Shore D. If the surface hardness of the enclosure layer is lower than the surface hardness of the inner sphere, restitution and durability become too low. The definition and measurement of the surface hardness of the enclosure layer are the same as described for the inner sphere. Where the enclosure consists of two or more layers, the surface hardness of the enclosure is the surface hardness of the outermost enclosure layer.

It is noted that the enclosure layer preferably has a gage of 0.5 to 10.5 mm, more preferably 1 to 9 mm. The specific gravity of the enclosure layer may be properly adjusted insofar as the objects of the invention are achievable.

A relatively hard, resilient member is preferably used as the enclosure layer 4. The enclosure layer may be formed of either a rubber base material like the above-mentioned inner sphere or a thermoplastic resin base material. The thermoplastic resins used herein are preferably, for example, polyester thermoplastic elastomers such as Hytrel 4767 (Toray-duPont K. K.) and ionomer resins such as Himilan (Mitsui-duPont Polychemical K. K.) and Surlyn (E. I. duPont). They may be used alone or in admixture of two or more. To the resin composition, inorganic fillers such as zinc oxide and barium sulfate as a weight adjuster and additives such as titanium dioxide for coloring purpose may be added.

The method of enclosing the inner sphere 3 with the enclosure layer 4 is not critical. The method employed where the enclosure layer is a rubber member involves previously molding a rubber material into half cups in a partially vulcanized state, encasing the inner sphere in a pair of half cups, and effecting heat compression molding under predetermined conditions. On the other hand, the method employed where the enclosure layer is a thermoplastic resin involves injection molding a molten enclosure layer-forming composition around the inner sphere.

The core 2 thus obtained preferably has a diameter of 32 to 41 mm, more preferably 34 to 40 mm.

The cover 5 surrounding the core 2 consists of inner and outer layers 6 and 7 wherein the outer layer 7 surrounds the inner layer 6. The cover outer layer 7 should have a hardness of 40 to 60, preferably 42 to 58 in Shore D. An outer layer hardness of less than 40 leads to resilience that is too low whereas an outer layer hardness of more than 60 adversely affects the spin upon approach shots and the hitting feel. The cover inner layer 6 should have a hardness of 55 to 70 in Shore D. An inner layer hardness of less than 55 would lead to resilience that is too low whereas an inner layer hardness of more than 70 leads to a hard hitting feel. Preferably the hardness of the cover inner layer is higher than the hardness of the cover outer layer. The difference in hardness between the inner and outer layers is preferably at least 5, especially 5 to 25 in Shore D.

Preferably the cover outer layer has a gage (radial thickness) of 0.3 to 3.0 mm, especially 0.5 to 2.5 mm and the cover inner layer has a gage of 0.5 to 3.0 mm, especially 0.7 to 2.8 mm. The overall cover gage, that is, the total gage of the inner and outer layers combined is preferably about 0.8 to 5.4 mm, more preferably 1.3 to 4.4 mm.

Hard resilient resins are preferred as the material of which the cover inner layer is formed. For example, commercially available ionomer resins such as Himilan AM7317, AM7318, 1605, 1706, 1557 and 1856 (Mitsui-duPont Polychemical K. K.) are preferred. Besides, thermoplastic resins such as polyesters, polyamides and polyurethanes are included. They may be used alone or in admixture of two or more.

Also, the material of which the cover outer layer is formed is not critical. Commercially available ionomer resins such as Surlyn 8120 (E. I. duPont) and Himilan 1706 (Mitsui-duPont Polychemical K. K.) are advantageously used as well as thermoplastic resins including polyesters, polyamides and polyurethanes. They may be used alone or in admixture of two or more.

Further, UV absorbers, antioxidants and dispersants such as metal soaps are added to the cover inner and outer layer compositions, if necessary.

It is understood that the method of enclosing the core with the cover is not critical. The core may be enclosed with the cover by preforming a pair of hemispherical half cups from a cover stock, encasing the core in the half cups and effecting heat compression molding or by injection molding cover stocks over the core.

The golf ball preferably has a hardness expressed by a distortion of 2.3 to 4.0 mm, more preferably 2.5 to 3.8 mm under an applied load of 100 kg. In this regard, the ratio of the hardness A of the inner sphere to the hardness B of the golf ball, both expressed by a distortion under an applied load of 100 kg, is in the range: $1.1 \leqq A/B \leqq 3.5$, preferably $1.1 \leqq A/B \leqq 3.0$. With $A/B<1.1$, the ball is too soft and loses restitution. With $A/B>3.5$, the ball is too hard and presents a hard hitting feel.

It is noted that the parameters such as weight and diameter of the ball are properly determined in accordance with the Rules of Golf.

With the above construction, the performance of the golf ball of the invention is least dependent on the head speed of a driver and little affected by the number of a club. Upon full shots with a driver wherein to the large deformation region of the ball, especially by low-head speed players, the ball is given a sufficient deformation and provides a very pleasant soft hitting feel while maintaining high restitution independent of whether the head speed is high or low. In addition, upon approach shots with a sand wedge belonging to the small ball deformation region, the ball is susceptible to spin and easy to control. Furthermore, upon approach shots and putting, the ball gives a soft pleasant feel.

According to the invention, the ball gives a pleasant hitting feel while maintaining high restitution upon full shots with a driver independent of whether the head speed is high or low and at the same time, is improved in spin performance upon approach shots with a sand wedge etc. and in hitting feel upon approach shots and putting.

EXAMPLE

Examples of the present invention are given below together with Comparative Examples by way of illustration. The invention is not limited to the following Examples.

Examples and Comparative Examples

Inner spheres were prepared by milling an inner sphere-forming composition of the formulation shown in Table 1 in a roll mill and molding and vulcanizing it in a mold at 155° C. for 15 minutes. Where the enclosure layer was a rubber member, a core was prepared by milling a rubber composition of the formulation shown in Table 1 in a roll mill, molding the composition into partially vulcanized half cups, encasing the inner sphere in a pair of the half cups, and heat compression molding at 155° C. for 15 minutes (Examples 5 and 6). Where the enclosure layer was a thermoplastic resin, a core was prepared by injection molding an enclosure-forming composition of the formulation shown in Table 1 over the inner sphere (Examples 1–4).

Inner and outer cover stocks of the formulation shown in Table 1 were successively injection molded over the thus obtained core, yielding golf balls of four-layer structure of Examples 1–6. Comparative Examples 1 to 3 were three-piece golf balls consisting of a core and a two-layer cover. Comparative Example 4 was a two-piece golf ball consisting of a core and a single layer cover. Note that the blending amounts shown in Table 1 are all parts by weight and their relative proportion is independent among the inner sphere, enclosure layer, cover inner layer and cover outer layer.

TABLE 1

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Inner sphere | Cis-1,4-polybutadiene | 100 | 100 | 100 | 100 | 100 | 100 | 100 | 100 | 100 | 100 |
| | Zinc acrylate | 17.5 | 20.4 | 17.5 | 16.9 | 20.4 | 16.9 | 21.2 | 21.2 | 33.6 | 33.6 |
| | Dicumyl peroxide | 1.2 | 1.2 | 1.2 | 1.2 | 1.2 | 1.2 | 1.2 | 1.2 | 1.2 | 1.2 |
| | Antioxidant | 0.2 | 0.2 | 0.2 | 0.2 | 0.2 | 0.2 | 0.2 | 0.2 | 0.2 | 0.2 |
| | Zinc oxide | 5 | 5 | 5 | 5 | 5 | 5 | 5 | 5 | 5 | 5 |
| | Barium sulfate | 56.9 | 35.1 | 36.2 | 45.9 | 39.5 | 37.3 | — | — | — | — |
| Enclosure layer | Cis-1,4-polybutadiene | — | — | — | — | 100 | 100 | — | — | — | — |
| | Zinc acrylate | — | — | — | — | 28.8 | 37.2 | — | — | — | — |
| | Dicumyl peroxide | — | — | — | — | 1.2 | 1.2 | — | — | — | — |
| | Antioxidant | — | — | — | — | 0.2 | 0.2 | — | — | — | — |
| | Zinc oxide | — | — | — | — | 5 | 5 | — | — | — | — |
| | Barium sulfate | — | — | — | — | 36.4 | 29.6 | — | — | — | — |
| | Surlyn 8120*1 | 50 | — | — | — | — | — | — | — | — | — |
| | Himilan 1706*2 | 50 | — | — | — | — | — | — | — | — | — |
| | Hytrel 4767*3 | — | 100 | 100 | — | — | — | — | — | — | — |
| | Himilan AM7317*2 | — | — | — | 50 | — | — | — | — | — | — |
| | Himilan AM7318*2 | — | — | — | 50 | — | — | — | — | — | — |
| Cover inner layer | Himilan AM7317*2 | 50 | — | 50 | — | — | — | — | — | — | — |
| | Himilan AM7318*2 | 50 | — | 50 | — | — | — | — | — | — | — |
| | Himilan 1605*2 | — | 50 | — | 30 | 50 | 50 | — | — | 50 | — |
| | Himilan 1706*2 | — | 50 | — | — | 50 | 50 | — | — | 50 | — |
| | Himilan 1557*2 | — | — | — | 50 | — | — | — | 50 | — | — |
| | Himilan 1856*2 | — | — | — | 20 | — | — | — | — | — | — |
| | Hytrel 4767*3 | — | — | — | — | — | — | 100 | — | — | — |
| | Himilan 1601*2 | — | — | — | — | — | — | — | 50 | — | — |
| Cover outer layer | Surlyn 8120*1 | 100 | 100 | 50 | 100 | 100 | 50 | — | 100 | 100 | 100 |
| | Himilan 1706*2 | — | — | 50 | — | — | 50 | 50 | — | — | — |
| | Himilan 1605*2 | — | — | — | — | — | — | 50 | — | — | — |

*1ionomer resin by E. I. duPont
*2ionomer resin by Mitsui-duPont Polychemical K.K.
*3polyester thermoplastic elastomer by Toray-dupont K.K.

Next, the golf balls thus obtained were examined for flight performance and hitting feel by the following tests. The results are shown in Table 2.

Flight Performance

Using a swing robot, the ball was hit with a driver (PRO 230 Titan, loft angle 10°, manufactured by Bridgestone Sports Co., #W1) at a head speed of 50 m/sec. (HS50) and a head speed of 35 m/sec. (HS35) to measure a spin rate, carry and total distance. Also, the ball was hit with a sand wedge (J's Classical Edition, manufactured by Bridgestone Sports Co., #SW) at a head speed of 20 m/sec. (HS20) to measure a spin rate.

Hitting Feel

Five professional golfers and five female top amateur golfers actually hit the ball with a driver (#W1) at a head speed of about 50 m/sec. (HS50) and a head speed of about 35 nm/sec. (HS35), respectively, to examine the ball for hitting feel according to the following criterion.

○: soft feel

Δ: ordinary

X: hard feel

Five professional golfers actually hit the ball with a sand wedge (#SW) at a head speed of about 20 m/sec. (HS20) to examine the ball for hitting feel according to the following criterion.

○: soft feel

Δ: ordinary

X: hard feel

TABLE 2

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Structure | | 4-layer | 4-layer | 4-layer | 4-layer | 4-layer | 4-layer | 3-layer | 3-layer | 3-layer | 2-layer |
| Inner sphere | Diameter (mm) | 31.9 | 33.7 | 33.7 | 33.7 | 27.9 | 24 | 35.1 | 35.3 | 35.3 | 38.7 |
| | Hardness (100 kg) A*4 (mm) | 6.0 | 5.0 | 6.0 | 7.0 | 5.0 | 7.0 | 4.8 | 4.8 | 2.9 | 2.9 |
| | Surface hardness $H_1$ (Shore D) | 36 | 41 | 36 | 29 | 41 | 29 | 42 | 42 | 54 | 54 |

TABLE 2-continued

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Enclosure layer | Gage (mm) | 1.8 | 1.5 | 1.5 | 1.5 | 3.4 | 5.75 | — | — | — | — |
| | Surface hardness $H_2$ (Shore D) | 53 | 47 | 47 | 68 | 50 | 56 | — | — | — | — |
| Hardness difference ($H_2 - H_1$) | | 17 | 6 | 11 | 39 | 9 | 27 | — | — | — | — |
| Cover inner layer | Gage (mm) | 1.8 | 1.5 | 1.5 | 1.5 | 2.0 | 1.8 | 1.8 | 1.9 | 1.9 | — |
| | Hardness $H_3$ (Shore D) | 68 | 65 | 68 | 61 | 65 | 65 | 47 | 63 | 65 | — |
| Cover outer layer | Gage (mm) | 1.8 | 1.5 | 1.5 | 1.5 | 2.0 | 1.8 | 2.0 | 1.8 | 1.8 | 2.0 |
| | Hardness $H_4$ (Shore D) | 47 | 47 | 53 | 47 | 47 | 53 | 65 | 47 | 47 | 47 |
| Hardness difference ($H_3 - H_4$) | | 21 | 18 | 15 | 14 | 18 | 12 | −18 | 16 | 18 | — |
| Ball | Hardness (100 kg) B*4 (mm) | 3.2 | 3.2 | 3.4 | 3.3 | 3.0 | 2.8 | 2.9 | 3.0 | 2.3 | 2.7 |
| Hardness ratio A/B | | 1.88 | 1.56 | 1.76 | 2.12 | 1.67 | 2.50 | 1.66 | 1.60 | 1.26 | 1.07 |
| #W1/HS50 | Spin (rpm) | 2600 | 2620 | 2570 | 2650 | 2680 | 2680 | 2480 | 2560 | 2750 | 2770 |
| | Carry (m) | 231.2 | 231.0 | 231.4 | 230.7 | 230.2 | 230.4 | 231.8 | 227.1 | 230.5 | 228.4 |
| | Total (m) | 256.1 | 256.3 | 256.9 | 255.8 | 255.2 | 255.5 | 257.0 | 252.3 | 255.1 | 252.8 |
| | Feel | ○ | ○ | ○ | ○ | ○ | ○ | ○ | ○ | Δ | Δ |
| #W1/HS35 | Spin (rpm) | 4220 | 4240 | 4050 | 4180 | 4280 | 4200 | 3900 | 4270 | 4430 | 4470 |
| | Carry (m) | 140.8 | 140.5 | 141.6 | 141.0 | 140.5 | 140.8 | 141.9 | 138.7 | 138.7 | 139.0 |
| | Total (m) | 152.6 | 152.2 | 153.6 | 153.0 | 152.6 | 152.8 | 154.0 | 150.6 | 150.3 | 150.5 |
| | Feel | ○ | ○ | ○ | ○ | ○ | ○ | ○ | ○ | × | × |
| #SW/HS20 | Spin (rpm) | 5730 | 5720 | 5610 | 5700 | 5730 | 5630 | 4030 | 5720 | 5800 | 5740 |
| | Feel | ○ | ○ | ○ | ○ | ○ | ○ | × | ○ | Δ | ○ |

*4a distortion (min) under an applied load of 100 kg

It is evident from the data of Table 2 that Comparative Example 1 is a three-piece golf ball of the same type as described in JP-A 24084/1995, which presents a soft feel upon driver shots due to the softness of the core and the intermediate layer (cover inner layer) and presents a hard feel and low spin susceptibility upon sand wedge shots due to the hardness of the cover. Comparative Example 2 is a soft core three-piece golf ball of the same type as described in JP-A 24085/1995, which presents a soft feel upon driver shots due to the softness of the core and is insufficiently resilient to travel distances due to the softness of the core and cover. Comparative Example 3 is a relatively hard core three-piece golf ball of the same type as described in JP-A 24085/1995, which presents a relatively hard feel and is inferior in hitting feel and flight distance especially at low head speeds. Comparative Example 4 is a two-piece golf ball of the conventional spin type which is improved in spin and hitting feel upon sand wedge shots, but presents a hard hitting feel and a large spin rate to travel a distance upon driver shots because the core is hard and the cover is a soft single layer.

In contrast, the multi-piece solid golf balls of the invention were found to travel a longer distance and present a soft hitting feel upon driver shots independent of whether the head speed is high or low and at the same time, present a soft hitting feel and satisfactory spin performance upon sand wedge shots.

What is claimed is:

1. A multi-piece solid golf ball comprising; a core consisting of an inner sphere and an enclosure layer surrounding the inner sphere and a cover surrounding the enclosure layer, said cover consisting of an outer layer and an inner layer, the outer layer of said cover having a hardness in the range of 40 to 60 in Shore D and a gage in the range of 1.5 to 3.0 mm, the inner layer of said cover having a hardness in the range of 55 to 70 in Shore D and a gage in the range of 0.5 to 3.0 mm, said enclosure layer having a surface hardness higher than the surface hardness of said inner sphere by 5 to 55 in Shore D, said inner sphere having a distortion of 3.0 to 8.0 mm under an applied load of 100 kg to the outer surface of said inner sphere, and the ratio of a hardness A of said inner sphere to a hardness B of the golf ball, both expressed by a distortion under an applied load of 100 kg, is in the range: $1.1. \leqq A/B \leqq 3.5$.

2. The multi-piece solid golf ball of claim 1 wherein said inner sphere is formed mainly of a rubber base material and has a diameter of 20 to 37 mm, and said core has a diameter of 32 to 41 mm.

3. The multi-piece solid golf ball of claim 1 wherein the difference in hardness between the outer layer and the inner layer is at least 5 in Shore D.

4. The multi-piece solid golf ball of claim 1, wherein the hardness of the cover inner layer is higher than the hardness of the cover outer layer.

5. The multi-piece solid golf ball of claim 1, wherein said inner sphere has a distortion in the range of 3.5 to 7.5 mm under an applied load of 100 kg.

6. The multi-piece solid golf ball of claim 1, wherein said inner sphere has a surface hardness in the range of 15 to 55 in Shore D.

7. The multi-piece solid golf ball of claim 1 wherein said inner sphere comprises CIS-1,4-polybutadiene containing at least 40% CIS-structure.

8. The multi-piece golf ball of claim 1, wherein said enclosure layer has a surface hardness in the range of 40 to 70 in Shore D.

9. The multi-piece golf ball of claim 1, wherein the surface hardness of said enclosure layer is higher than that of said inner sphere by 5 to 45 in Shore D.

10. The multi-piece golf ball of claim 1, wherein said enclosure layer has a gage in the range of 0.5 to 10.5 mm.

11. The multi-piece solid golf ball of claim 1, wherein the hardness of said cover inner layer is higher than the hardness of said cover outer layer by 5 to 25 in Shore D.

12. The multi-piece solid golf ball of claim 1, wherein said cover outer layer has a gage in the range of 0.5 to 2.5 mm and said cover inner layer has a gage in the range of 0.7 to 2.8 mm.

13. The multi-piece solid golf ball of claim 1, wherein a total gage of said inner and outer layers combined is in the range of 0.8 to 5.4 mm.

* * * * *